US010234137B2

(12) United States Patent
Ricci et al.

(10) Patent No.: US 10,234,137 B2
(45) Date of Patent: Mar. 19, 2019

(54) BURNER WITH ADJUSTABLE INJECTION OF AIR OR OF GAS

(71) Applicant: Fives Pillard, Marseilles (FR)

(72) Inventors: Louis Ricci, Roquefort-la-Bedoule (FR); Gael Le Piver, Marseilles (FR)

(73) Assignee: FIVES PILLARD, Marseilles (FR)

( * ) Notice: Subject to any disclaimer, the term of this patent is extended or adjusted under 35 U.S.C. 154(b) by 63 days.

(21) Appl. No.: 15/501,311

(22) PCT Filed: Jun. 25, 2015

(86) PCT No.: PCT/FR2015/051726
§ 371 (c)(1),
(2) Date: Feb. 2, 2017

(87) PCT Pub. No.: WO2016/020587
PCT Pub. Date: Feb. 11, 2016

(65) Prior Publication Data

US 2017/0219206 A1 Aug. 3, 2017

(30) Foreign Application Priority Data

Aug. 6, 2014 (FR) ..... 14 01811

(51) Int. Cl.
*F24C 7/00* (2006.01)
*F23D 17/00* (2006.01)
*F23C 7/00* (2006.01)

(52) U.S. Cl.
CPC ..... *F23D 17/00* (2013.01); *F23C 7/006* (2013.01); *F23D 17/005* (2013.01); *F23D 2900/21* (2013.01)

(58) Field of Classification Search
CPC ..... F23C 7/006
(Continued)

(56) References Cited

U.S. PATENT DOCUMENTS 3,527,262 A * 9/1970 Fuchs ..... F02B 53/00 123/240
4,726,182 A 2/1988 Barbier
(Continued)

FOREIGN PATENT DOCUMENTS

FR 2 572 463 5/1986
FR 2 780 489 12/1999
(Continued)

OTHER PUBLICATIONS

International Search Report dated Oct. 1, 2016 (6 pages including English translation) out of PCT priority Application No. PCT/FR2015/051726.
(Continued)

*Primary Examiner* — Avinash Savani
(74) *Attorney, Agent, or Firm* — Brinks Gilson & Lione; John C. Freeman

(57) ABSTRACT

A burner that includes a primary air or gas duct delimited by an exterior wall and a concentric interior wall of axis X and ducts for radial primary air or gas injection is described. The air or gas duct includes a ring that is rotationally mobile and has axial protrusions constituting distributors which collaborate with the radial primary air ducts arranged on the interior wall and form two passages of different angles in each duct. Rotating the ring making it possible to vary the angle of injection of the radial primary air. Thus, the regulation is situated just at the tip of the burner, in the region of the outlet of the primary air into the kiln, by modifying the outlet angle of the radial component for fixed section, thereby greatly simplifying the regulating of the burner.

14 Claims, 10 Drawing Sheets

(58) Field of Classification Search
USPC ..... 431/354
See application file for complete search history.

(56) References Cited

U.S. PATENT DOCUMENTS

| | | | | |
|---|---|---|---|---|
| 5,490,378 | A | 2/1996 | Berger | |
| 2008/0213714 | A1* | 9/2008 | Knoch | F23D 1/00 431/284 |

FOREIGN PATENT DOCUMENTS

| | | |
|---|---|---|
| FR | 2 901 852 | 12/2007 |
| JP | H07 332671 | 12/1995 |

OTHER PUBLICATIONS

Written Opinion dated Oct. 1, 2016 (5 pages) out of PCT priority Application No. PCT/FR2015/051726.

* cited by examiner

BURNER WITH ADJUSTABLE INJECTION OF AIR OR OF GAS

This application claims priority to International Application No. PCT/FR2015/051726 filed Jun. 25, 2015 and to French Application No. 1401811 filed Aug. 6, 2014; the entire contents of each are incorporated herein by reference.

BACKGROUND

The present invention relates to the field of burners in all fields and of all fuels and notably but not limitingly to burners for rotary (or rotating) kilns or ovens, such as cement kilns or lime kilns.

SUMMARY

In most rotating-kiln installations, the majority of the combustion air, generally referred to as secondary air, arrives at a very high temperature (between 600 to 1200° C.) and low speed (between 4 and 10 m/s) having been used as cooling air to cool the hot material falling from the kiln.

In a cement kiln this hot secondary air represents between 80 and 95% of the combustion air of the kiln.

The complementary air, referred to as primary air, is the air injected directly into the burner at a lower temperature (temperature close to ambient temperature in the majority of cases) but at high speed.

It generally represents between 5% and 20% of the combustion air and has two functions:

The cooling and mechanical integrity of the kiln burner.

Activation of combustion and control of flame shape. To do this, this primary air is injected at the tip of the burner, at high pressure (between 100 and 500 mbar) and at high speed (between 80 and 350 m/s) with a view to:

Drawing the hot secondary air into the heart of the flame and ensuring that it mixes rapidly with the fuel of the burner thereby activating combustion.

Controlling, by its axial and radial components, the flame shape such as the width and length thereof, and adapting to the specific conditions of the kiln.

Rotary-kiln burners are generally characterized by their primary air impulse which is the force generated by the expansion of the primary air in the kiln (primary air mass flow rate x speed of expansion of the primary air) divided by the calorific power of the burner.

The high-pressure and low-temperature primary air has an impact on the energy balance of the method because it consumes electricity required to pressurize it and because it introduces cold air into the process.

In order to minimize this impulse and optimize the use thereof, it is important to have a maximum speed of expansion of this primary air for drawing in secondary air. It is therefore recommended that:

the expansion of this primary air be performed at the very tip of the end piece in order to derive full benefit from the speed of expansion, the pressure before the tip of the burner should not be affected by regulating or pressure-drop components, so that the maximum speed of expansion can be achieved at the tip.

The injections of primary air at the tip of rotary-kiln burners generally are made up of at least two primary air outlets, at least one of which is axial and the others radial (or rotational). In that case, regulating the proportion between the flow rate and/or the pressure of axial and radial air allows adjustment of the overall radial component of the primary air and causes the flame shape to vary.

These burners are therefore generally equipped with devices for regulating the axial and/or radial pressure which decreases the pressure and therefore the speed of expansion of these airs at the tip of the burner. They therefore reduce the impulse of the burner which is proportional to the expansion speed. In order to compensate for the drop in pressure due to the regulation and to maintain the impulse of the burner which is used to obtain an equivalent process operation or combustion result, it is therefore necessary to increase the flow rate or the pressure of the primary air. For many of these burners, the injection of powdered fuel (carbon, pet coke, etc. which are the fuels predominantly used in a rotating kiln) is sandwiched between the axial primary air on the outside and the radial air on the inside. As a result, for the same primary-air impulse, this radial outlet does not fully contribute to the absorption of secondary air into the flame. A greater primary-air impulse is therefore required in order to achieve an equivalent result.

In addition, arranging the radial air inside the powdered-fuel circuit increases the risk of fuel being ejected from the flame, and this may create unfavourable operating conditions (deterioration in the quality of firing of the product, operational difficulties, reduction in the life of the brickwork lining the kiln, etc.) and increase the emissions of NOx, because the fuel concentration in the centre of the flame is too low thereby preventing the recombustion phenomenon that reduces NOx.

The injections of primary air at the tip of the burners of a rotary kiln may also have a single primary air outlet with an adjustable radial component. In that case:

either the radial component is obtained by axial/radial mixing upstream and the same set of problems are encountered as with burners that have two primary air outlets, namely a loss in efficiency associated with the use of a regulating member that creates pressure drops and causes the speed of expansion of the primary air to drop, or the radial component is obtained by orientation of the outlet sections of the burner. This orientation needs to be done without any particular pressure drop in order for the burner to enjoy the benefit of an optimal speed of expansion of the primary air at the end piece and therefore the best energy efficiency.

Control over the flame diameter is more difficult to achieve in burners with a single primary air outlet with adjustable radial component. This is because, while in burners having two or more outlets the axial outlet is generally situated at the periphery of the burner in order to control and stabilize the divergence of the flow and allow more effective and finer adjustment of the flame diameter, this advantage does not exist in burners with a single outlet, making regulating the diameter more difficult. An excessive flame diameter can have serious consequences on the operating conditions of the process (affecting the nature of the material to be fired and/or the operating conditions) and/or on the life of the refractory linings of the kiln.

For burners used in fields other than that of rotary kilns, some of the combustion air may also be set in rotation in order to create turbulence and promote better mixing between the air and the fuel. The present invention applies also to such burners, whether the air be referred to as primary air, combustion air or radial air or rotational air or staged air.

In the remainder of the description, this proportion of combustion air will be termed primary air.

In many burners, including rotary-kiln burners, the set of problems described hereinabove in relation to the air applies also to the gaseous fuels such as natural gas, industrial process gas (from refinery, the iron and steel industry, etc.) the radial outlet angle and speed of which it is important to regulate.

It is an object of the present invention to propose a burner that allows a progressive and linear adjustment of the radial component of the primary air or of the gas and that makes it possible to avoid regulation by reducing the pressure (and therefore the speed of expansion) of a radial or axial component and therefore makes it possible to maintain the maximum impulse of the primary air or of the gas.

The burner according to the invention comprises a primary air or gas duct of axis X delimited by an exterior wall and a concentric interior wall and ducts for radial primary air injection; it is characterized in that the primary air or gas duct comprises a ring that is rotationally mobile and has axial protrusions constituting distributors which collaborate with the gas or radial primary air ducts arranged at the tip of the burner on the exterior peripheral part of the interior wall and form two passages of different angles in each duct. Rotating the ring will make it possible to distribute the section of the radial primary air ducts between two series of intercalated passages.

Advantageously, the ring is also translationally mobile. The translating of the ring will make it possible to modify the passage section of the gas or radial primary air ducts. Specifically, the passage section is the sum of the sections of the ducts constituting the gas or primary air duct and it is smaller than the outlet section; the passage section is therefore adjustable.

A first series of ducts has a small radial primary air injection angle (generally comprised between −10 and +30°) while the other series has a larger radial primary air injection angle than the preceding series (generally comprised between +10 and +60°.

The resultant injection angle for the gas or the radial primary air is the combination of the jets of air coming from the two intercalated series of passages, one at a small angle and the other at a large angle.

Regulating the rotation of the ring about the axis X makes it possible to vary the distribution of section and therefore the flow rate of primary air or of gas between these two series of ducts and therefore to regulate the radial air injection angle.

This distribution of section between the two series of ducts takes place at constant total section, thereby greatly simplifying regulation of the burner.

In addition, the regulation takes place just at the tip of the burner, at the outlet of the primary air or of the gas into the kiln, and as a result of this positioning of the regulation at the tip the outlet speed of the air or of the gas is maximized as, therefore, is the impulse.

This also avoids the rotating of moving parts in direct contact with the outside of the burner which are subjected to very high thermal stresses. This then minimizes the risk of damage to these parts.

Advantageously, the two passages are formed by complementary flared shapes of the distributor and of the radial primary air ducts and the sum of the sections of the said passages is constant is a plane perpendicular to X, whatever the angular position of the ring. The distributors and the gas or radial primary air ducts are of complementary flared shapes which form passages of constant section. Thus, regulation is achieved by modifying the outlet angle of the radial component with a constant outlet section thereby greatly simplifying the regulation of the burner.

Advantageously, the distributors and the radial gas or primary air ducts have walls with parallel edges.

Advantageously, the distributors and the radial primary air ducts have curvilinear edges. This shape makes it possible to limit pressure drops.

Advantageously, the mobile ring has at least one inclined slot and is turned by a translationally mobile collar to which it is connected by a nut sliding in the said groove. The translational movement of the collar thus allows the ring to be rotated.

According to one particular arrangement, the mobile collar is actuated by an actuating cylinder. The actuating cylinder may be hydraulic or mechanical or pneumatic.

Advantageously, the radial primary air ducts and the distributors are chamfered at the upstream end. The chamfer is in a plane tangential or in a plane that is vertical with respect to the flow of the air and allows the air to enter the passages and accelerate progressively thereby allowing a limited pressure drop.

Advantageously, the burner also comprises axial primary air ducts.

According to a particular arrangement, the radial primary air duct is sandwiched between the fuel ducts and the axial primary air duct.

Advantageously, the axial primary air and radial primary air ducts are fed from the same supply. This is highly advantageous, especially in the context of a burner having two primary air outlets (one axial and the other radial) which are situated on the outside of the fuel circuits, because that allows the burner to be lightened and makes it possible to limit the pressure drops in the inlet circuits, to have a burner which is simple to regulate. It is thus possible to regulate the rotation of the ring in order to increase the radial component and influence the flame diameter, and to regulate the air pressure upstream of the burner in order to regulate the impulse. That makes it possible to limit the maximum rotation by having a constant proportion between the axial exterior circuit and the interior circuit with adjustable radial component and to limit the maximum flame diameter and thus protect the refractories of the kilns from mistakes and/or bad regulation.

Advantageously, the number of gas or of radial primary air ducts is a multiple of the number of axial ducts or of a group of axial ducts.

Advantageously, the gas or radial primary air and axial ducts are arranged on the same radii. The number of outlet orifices of the radial air circuit or circuit with tangential component may be paired to the number of holes (or groups of holes) of the axial air circuit so that the impulse of the primary air of the two circuits contributes to best absorption of the secondary air. To this end, the angular layout of the axial air and radial air orifices is important and arrangement with the axial and radial orifices (or groups of orifices) on one and the same radius is advantageous, namely with the radial air ducts being situated radially directly beneath the axial air injection ducts.

Advantageously, the inclination and length of the slot is proportional to the rotation of the ring. The slot may have a length from 50 to 300 mm and a small inclination from 1 to 15° with respect to the axis X. The combination of a long slot and a small angle makes it possible to obtain high precision in the regulation.

According to one particular arrangement, the duct has an outlet section, this outlet section varies as a function of the movement of one wall with respect to the other, the interior radial face of the distributors and the external radial face of the notches make an angle $\alpha$ with the axis X, and the interior radial face of the exterior annulus makes an angle $\beta$ with the axis X. In certain applications and advantageously, the gas or radial primary air circuit, the outlet section may be adjusted in order to maintain a maximum pressure and therefore maximum speed of injection of the primary air or of the gas at the tip of the burner. This modification to section is obtained by relative movement along the axis X of the interior and exterior tubes of the circuit and a shape inclined along the axis X of the distributors mounted on the mobile ring and of the gas or radial primary air notches arranged on the exterior peripheral part of the interior tube of the circuit.

According to a particular arrangement, the gas or radial primary air duct is arranged on the outside of the fuel (powdered solid, liquid or other gas) circuits. This then limits any risk of liquid or solid fuel being splashed onto the periphery of the flame when the radial component of the air or of the gas is increased. In addition, this arrangement makes it possible to reduce NOx through a staged combustion effect, by concentrating the fuel in the centre of the flame.

According to an even more advantageous arrangement for controlling the flame diameter, the radial primary air duct is sandwiched between an axial air duct and the centre of the burner comprising the fuel (powdered solid, liquid or gaseous) ducts and possibly the flame stabilizer.

Advantageously, the distributors and the radial primary air ducts are of complementary flared shape, forming two passages and of which the sum of the sections is variable in a plane perpendicular to X, whatever the angular position of the ring. In certain applications, the gas or radial primary air circuit, the outlet section needs to be able to be adjusted in order to maintain a maximum pressure and therefore a maximum speed of injection of the primary air or of the gas at the tip of the burner. This modification to section is obtained by a relative movement along the axis X of the mobile ring and of the gas or radial primary air notches arranged on the exterior peripheral part of the interior tube of the circuit.

BRIEF DESCRIPTION OF THE DRAWINGS

Further advantages may yet become apparent to those skilled in the art from reading the examples below, illustrated by the attached figures given by way of example:

FIGS. 12 and 13 show a view in cross section of the burner in a particular arrangement in which the section of the gas or air circuit is adjustable. FIG. 12 is in the position of maximum section and FIG. 13 in the position of minimum section, FIG. 14 is in the position of maximum section, and FIG. 15 is in the position of minimum section.

DETAILED DESCRIPTION

Figure 1:
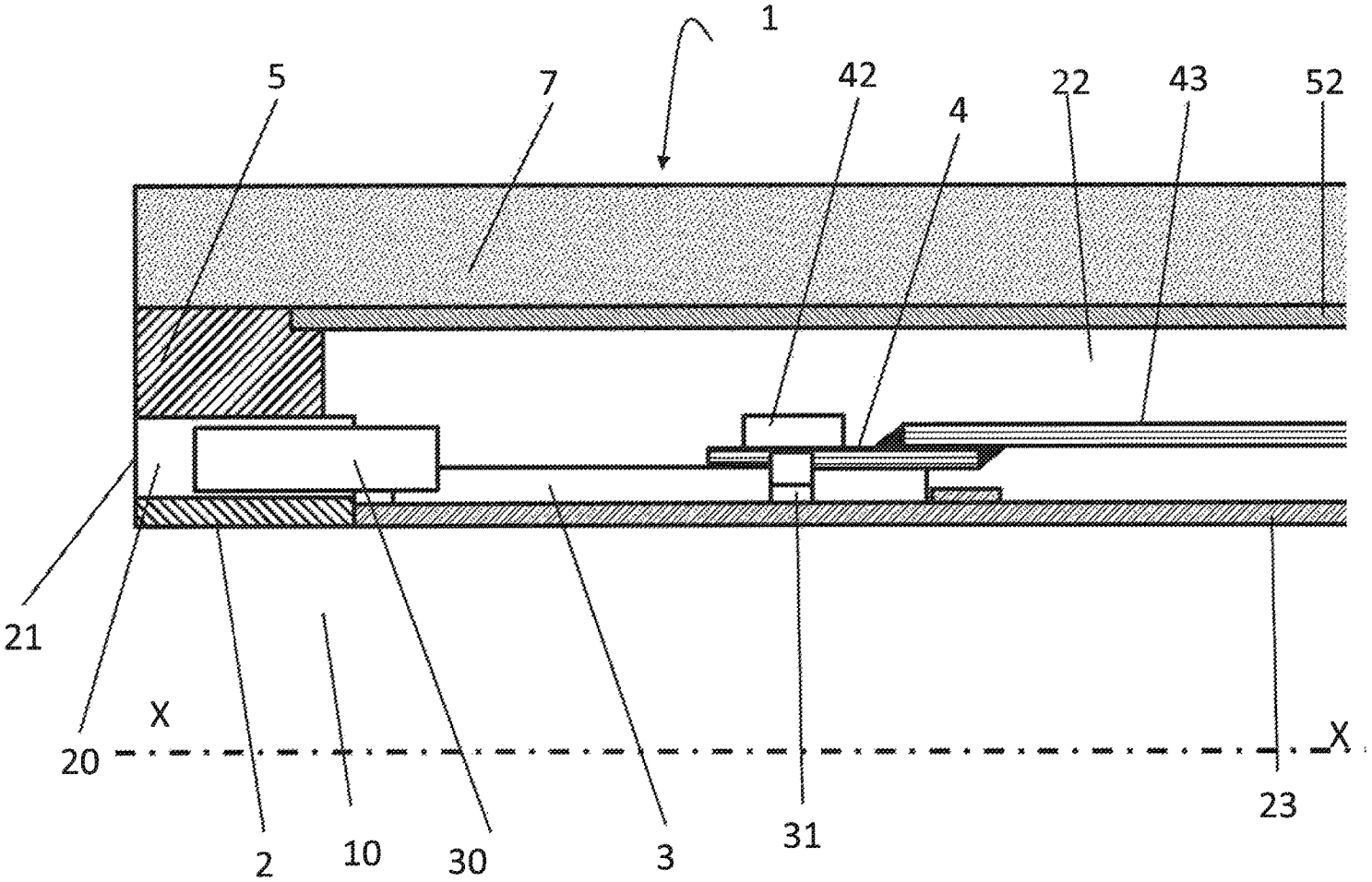
FIG. 1 is a view in cross section of a gas or air circuit of the burner according to the invention.

In the remainder of the description "downstream" will be the term used for parts positioned on the side of the arrival of the primary air and "upstream" will be the term used for those placed on the side of the outlet of the primary air.

The burner 1 comprises at least one gas or primary air duct 22 comprised between an exterior wall 52 and an interior wall 23 of axis X and constituting concentric tubes of cylindrical shape surrounding the centre of the burner 10 in which several other fuel or primary air ducts 100, 101 or a stabilizer 8 may be installed. The kiln-end of this duct is closed by an interior end annulus 2 and an exterior end annulus 5, which depending on the embodiment may be two distinct components in order to make machining easier, or one and the same component.

Figure 8:
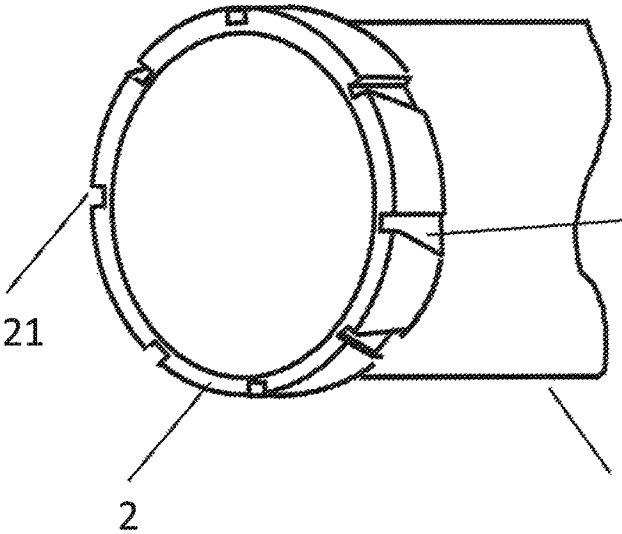
FIG. 8 is a view of the main duct.

The gas or primary air duct comprises a ring 3, itself surrounded by a collar 4. The downstream end of the duct is encircled by the annulus 5. As may be seen in FIGS. 1, 2 and 8, the interior annulus 2 connected to the interior tube of the wall 23 has on its periphery notches 20 which have two faces 200 and 201 flaring apart from one another (or in the shape of a V), which are closed at their peripheral part by the annulus 5 thus constituting radial primary air ducts 21.

In an advantageous arrangement illustrated, the exterior annulus 5 comprises primary air ducts 50 with an axial component.

Figure 7:
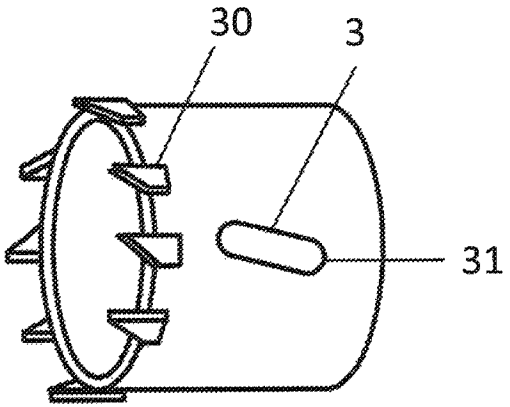
FIG. 7 is a view of the ring.

The ring 3 (cf. FIGS. 1, 2 and 7) has protrusions 30 of flared or V shape which are arranged in the notches 20 and constitute air distributors 30. Each protrusion 30 has two faces 300 and 301 which meet downstream and which are respectively parallel to the faces 200 and 201 of the notch 20. The V-shape therefore has its point facing downstream.

The ring 3 turns about the axis X on the main duct between two extreme positions, in which the distributor 30 is in abutment against the face 200 of the notch 20 or against the face 201 of the said notch 20. The ring 3 has at least one slot 31 arranged inclined with respect to the axis X.

In one particular arrangement illustrated, the collar 4 slides from upstream to downstream along the wall 23 along the axis X. The collar 4 has a pin, nut or key 42 which slides in the slot 31. The collar 4 is fixed to at least one control arm or rod 43 connected to a piston (not depicted) so as to cause the collar 4 to slide from upstream to downstream and vice-versa.

The operation of the burner 1 illustrated by FIGS. 3 to 5, 6*a* and 6*b* will now be described.

Each air distributor 30 allows the gas or primary air stream arriving in the gas or radial primary air duct 21 to be divided, and given a radial angular component by splitting it into two passages 210 and 211 with different angles. These passages 210 and 211 generate two jets which recombine into a single jet at the outlet and the mean angle of which is practically proportional to the outlet angle of each V, weighted by the flow rate of each jet. By rotating the ring 3 the distribution of section between the two passages 210 and 211 is varied, the overall section of the passages 210 and 211 being constant throughout the range of adjustment and therefore the flow rate in each of the branches of the V in order to obtain a variation in the outlet angle of the stream of air 6 without reducing the speed of ejection thereof and keeping the flow rate constant.

The gas or radial air component can thus be regulated by regulating the outlet angle of the jet, for the same pressure, for the same flow rate and for the same section upstream of the outlet orifice, thereby maximizing the impulse of the jet.

Figure 4:
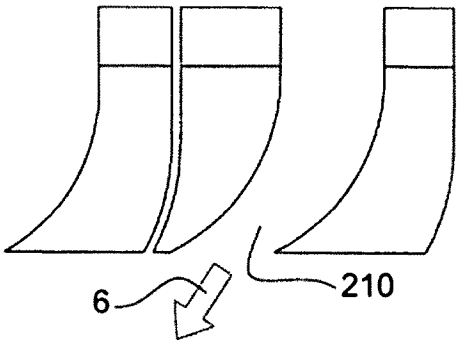
FIGS. 3 to 5 show various positions of a curved-edges distributor in a radial primary air duct.
Figure 3:
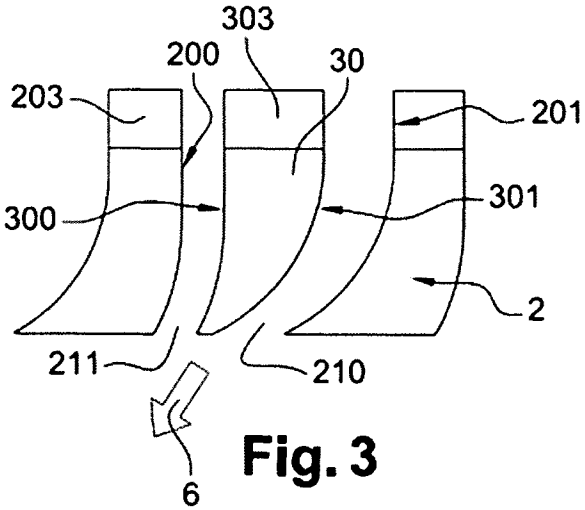
Figure 5:
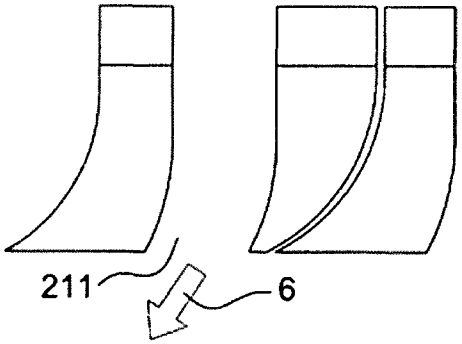
Figure 6A:
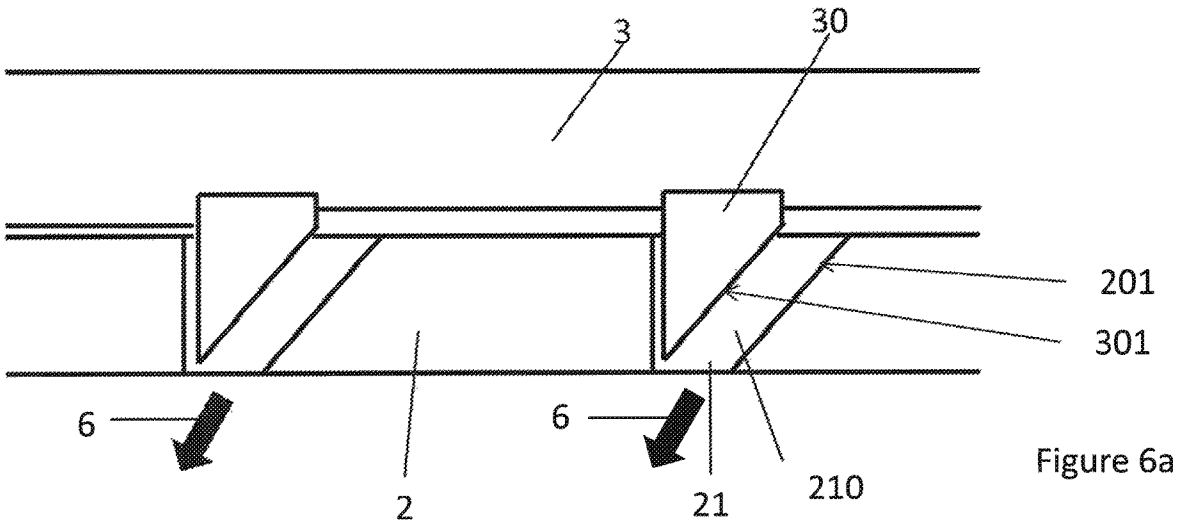
FIGS. 6*a* and 6*b* are development views of the distributor in the two extreme positions.
Figure 6B:
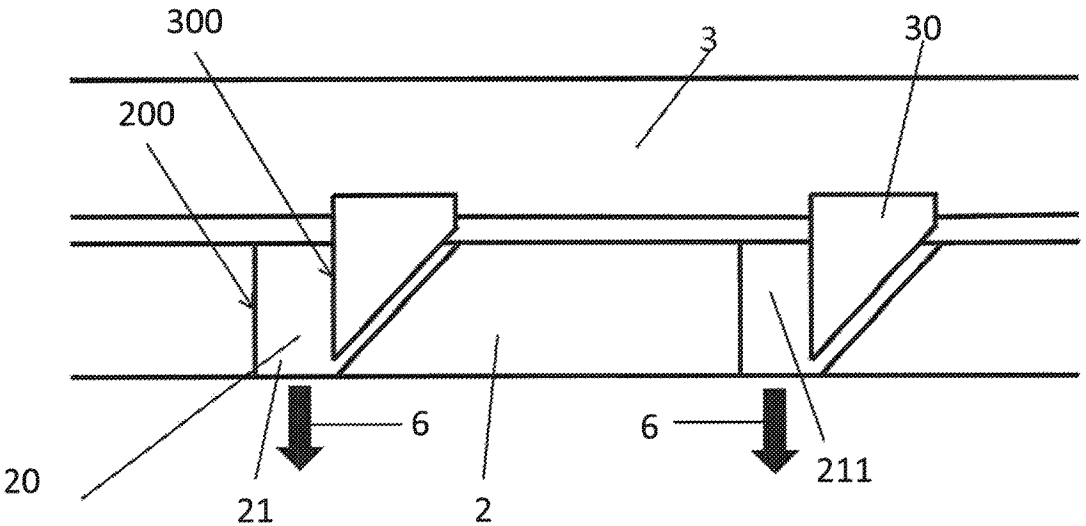

In the embodiment depicted in FIGS. 3 to 5, the passages 210 and 211 are curved, so as to reduce the drop in pressure in the passages through the progressive way in which speed is acquired according to the radial component and allow the jet greater aerodynamic stability. Specifically, the curved shape gives the jet on the inside of the bend a speed of expansion that is slightly lower than that on the outside of the bend. That makes the mixing of the two jets at different angles less turbulent and therefore makes for a more stable resultant flow and makes the mean speed of the jet more optimal.

In FIG. 3, the distributor 30 is positioned substantially in the middle, and the quantity of air passing along the two passages is substantially identical. In FIG. 4, the distributor 30 is pressed up against the wall 200 and the majority of the air passes along the more inclined passage 210, so the air stream 6 is therefore more steeply inclined. By contrast in FIG. 5, the distributor 30 is pressed up against the wall 201 and the majority of the air passes along the less inclined passage 211 so the air stream 6 is therefore very weakly inclined.

In FIGS. 3 to 5, chamfers 303, 203 are provided at the inlet of the air distributor 30 and at the inlet of the passages 210 and 211 in a tangential plane or in a vertical plane.

Figure 2:
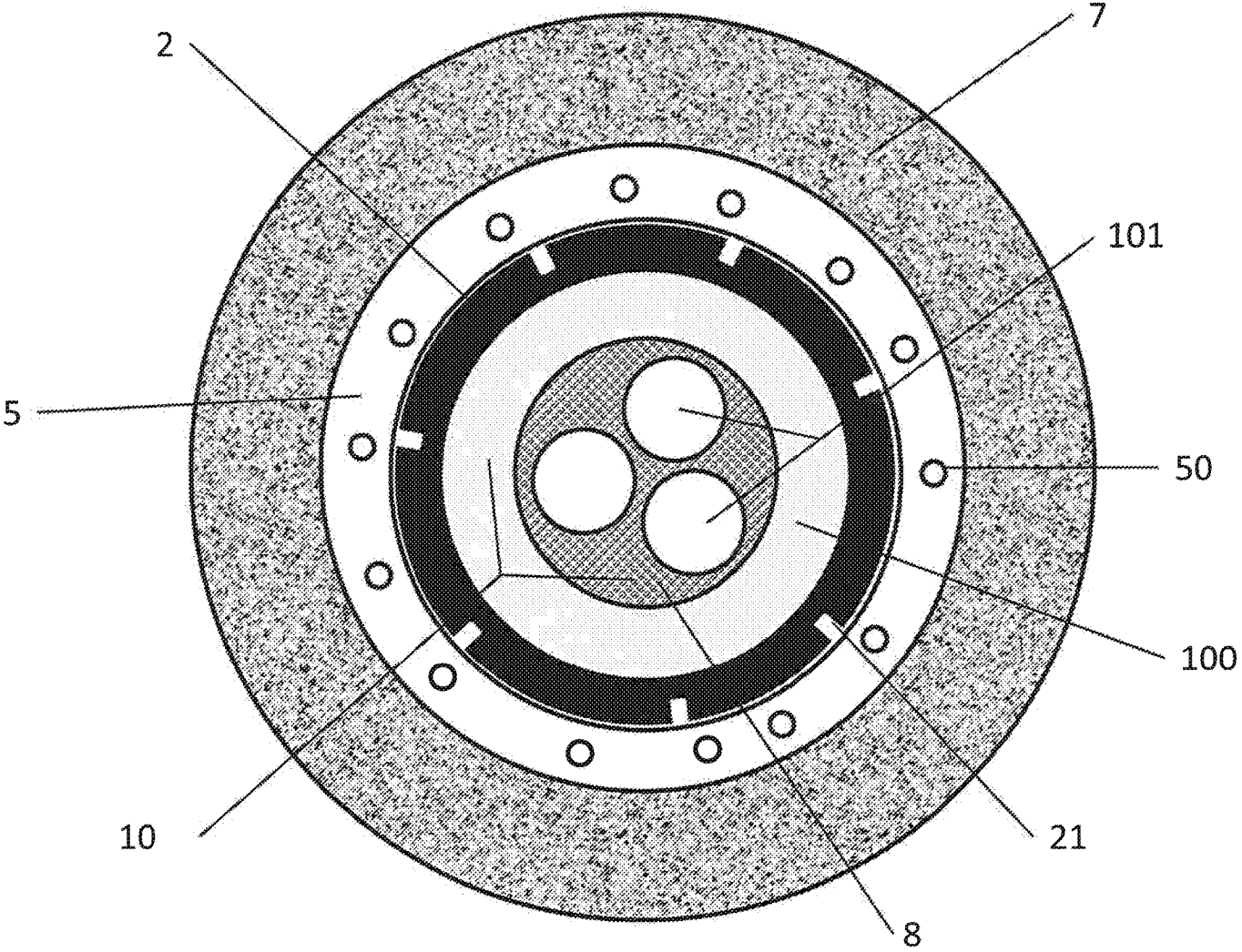
FIG. 2 is a front view of the burner according to one particular arrangement.

In the view that is FIG. 2, the burner comprises protective concrete 7 on the outside, the exterior annulus 5 with the axial ducts 50, the interior annulus 2 with the radial primary air ducts 21, and the centre of the burner 10 delimited on the outside by the wall 23 comprising a circuit 100 for powdered and/or gaseous fuel, and other fuel circuits 101 and a central stabilizer 8.

This type of burner can be used both if it has a single gas or primary air outlet with only the primary air ducts 21 or multiple outlets with the gas or primary air ducts 21 and 50.

In the case of a multiple primary air outlet, the ducts 50 and 21 may be fed with primary air from one and the same single primary air circuit 22 or by separate primary air circuits, which are generally concentric or near-concentric with respect to the axis X.

Figure 10:
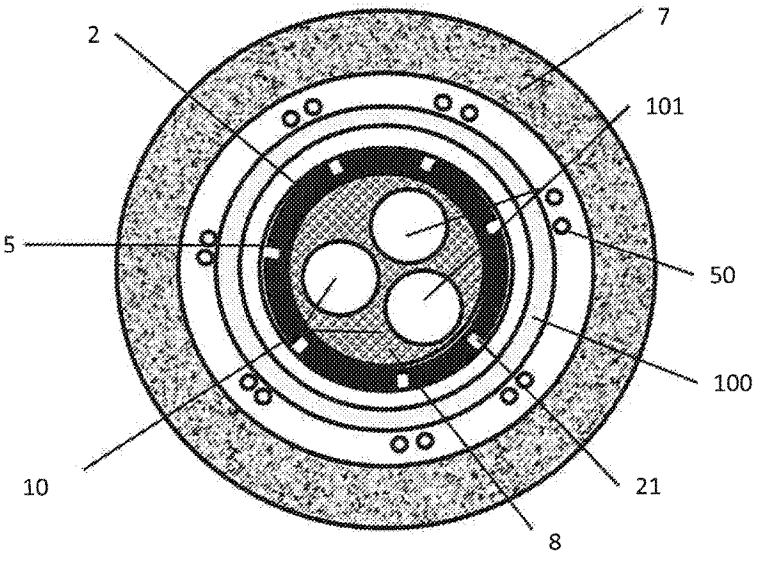
FIGS. 9 to 12 show front views of various arrangements of the fuel and primary air circuits at the burner.
Figure 9:
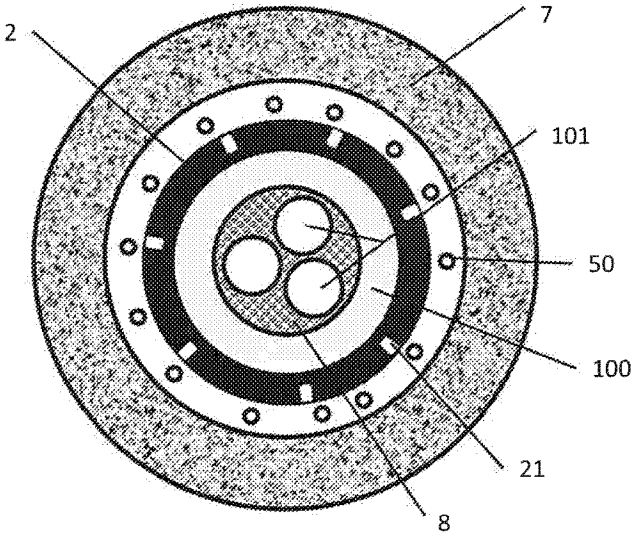
Figure 11:
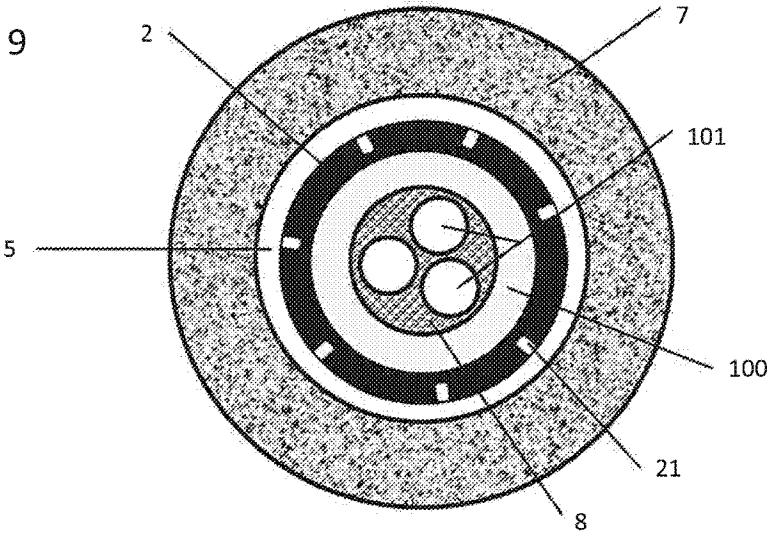

FIGS. 9 to 11 show various radial arrangements of the gas or primary air circuits according to the invention and of the annular fuel (powdered, gaseous fuel) circuit or circuits.

FIG. 9 shows an arrangement with, starting from the centre of the burner, at the centre a stabilizer 8, fuel circuit 101 in the stabilizer, a powdered-fuel circuit 100, a radial gas or primary air circuit with ducts 21, an axial circuit with ducts 50.

FIG. 10 shows an arrangement with, starting from the centre of the burner, in the centre a stabilizer 8, fuel circuit 101 in the stabilizer, a radial gas or primary air circuit with ducts 21, a powdered-fuel circuit 100, an axial circuit with ducts 50.

FIG. 11 shows an arrangement with, starting from the centre of the burner, at the centre a stabilizer 8, fuel circuit 101 in the stabilizer, a powdered-fuel circuit 100, a radial gas or primary air circuit with ducts 21 without an axial circuit.

Other arrangements which have not been depicted, such as, for example, with the powdered-fuel circuit 100 on the outside, are also possible.

Figure 12:
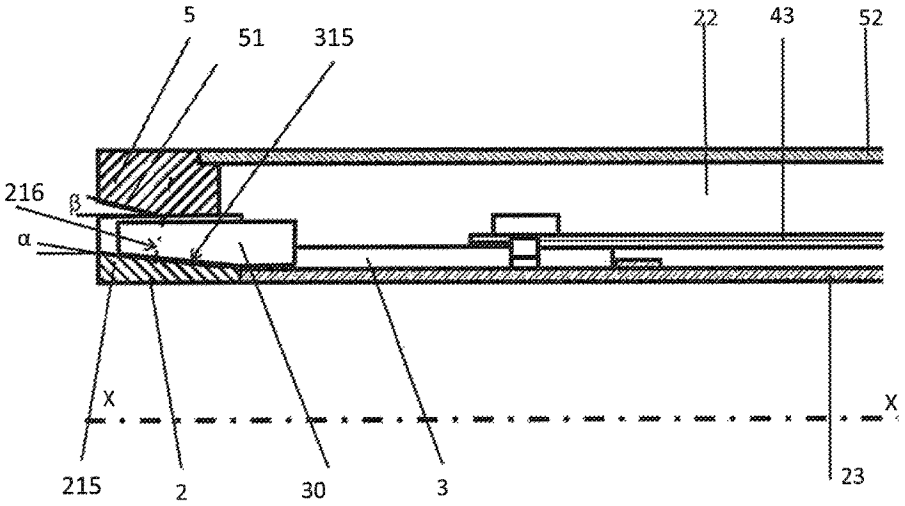
Figure 13:
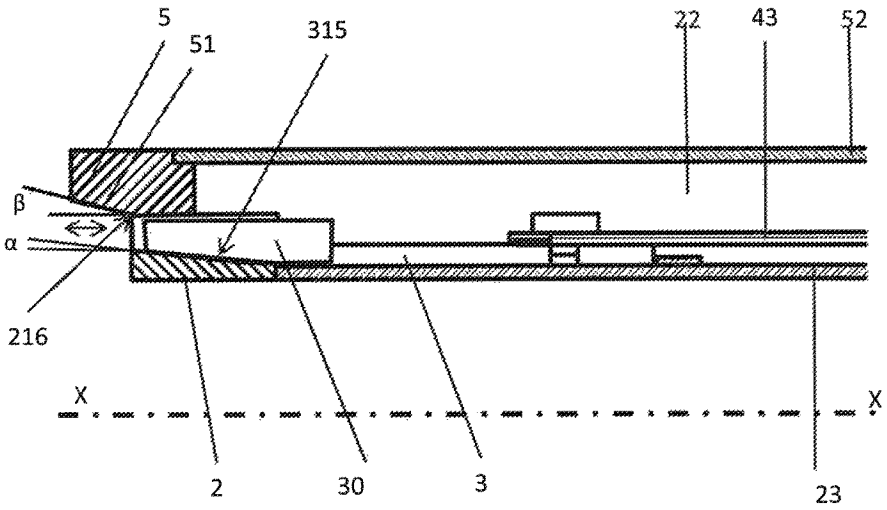

In certain applications and advantageously illustrated in FIGS. 12 and 13 the gas or radial primary air circuit 22, the minimum section of the radial component in the plane 216 can be adjusted at the tip of the burner in order to maintain a maximum pressure and therefore a maximum speed of injection of the gas or of the primary air at the tip of the burner. This modification to section is obtained by the moving along the axis X of one of the walls 23 or 52 with respect to the other, from the angular inclination a of the interior radial face 315 of the distributors 30 and the exterior radial face 215 of the gas or radial primary air notches 20 with respect to the axis X, and a divergent angle β on the interior radial face 51 of the exterior annulus 5. For preference, the interior wall 23 is mobile and the exterior wall 52 is fixed.

Figure 16A:
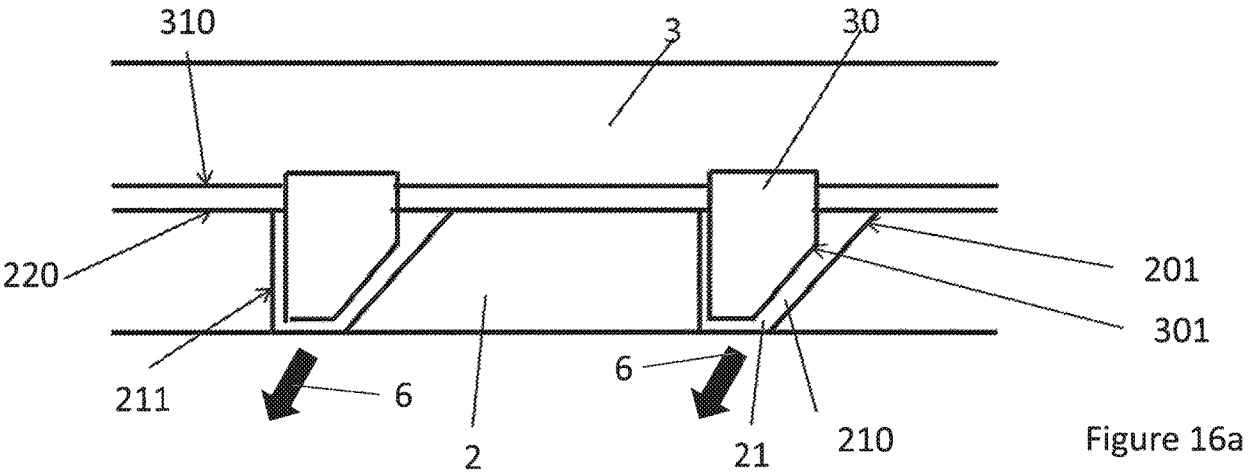
FIGS. 16*a* and 16*b* show various positions of the curved-edges distributors in a radial primary air duct.
Figure 16B:
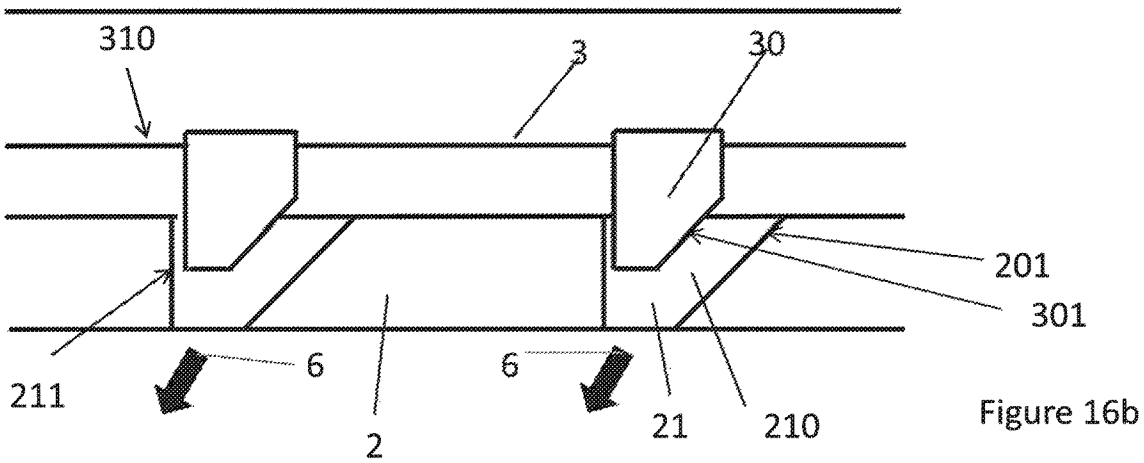

In FIG. 16*a* or 16*b*, the ring 3 also undergoes translational movement along the axis X on the main duct between two extreme positions in which the face 310 of the distributor 30 is in abutment on the face 220 in order to obtain a minimum passage section. The distributor 30 can be moved back for an increased passage section. The translational movement of the ring 3 or even the rotation thereof can be achieved using two independent relative movements. Section adjustment may also very well be achieved by a translational and/or rotational movement of the ring.

Figure 14:
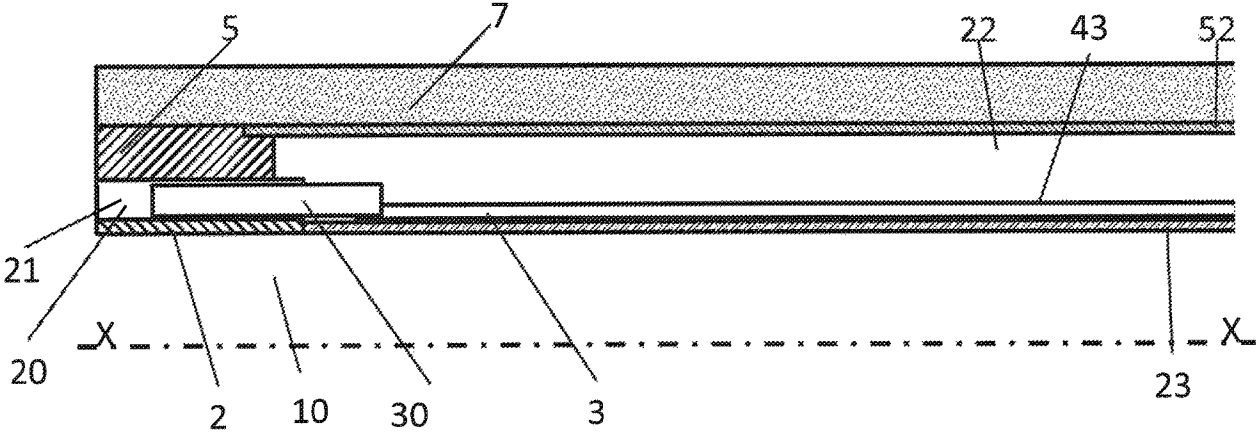
FIGS. 14 and 15 show a view in cross section of the burner in a particular arrangement in which the section of the gas or air circuit is adjustable by axial movement of the distributors.
Figure 15:
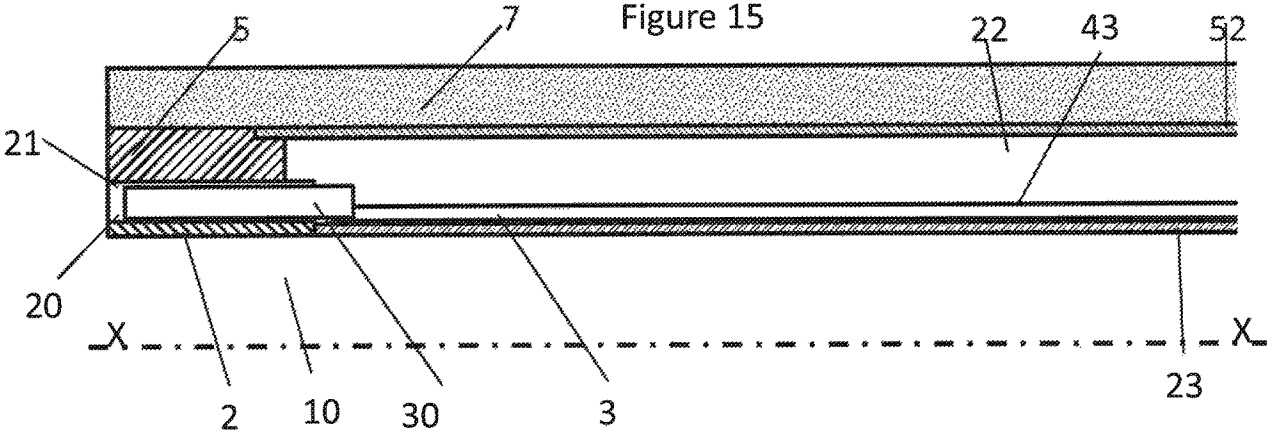

In the applications illustrated in FIGS. 14 and 15, in the gas or radial primary air circuit 22, the section of the radial component may be adjusted at the tip of the burner 1 in order to maintain a maximum pressure and therefore a maximum speed of injection of the gas or of the primary air at the tip of the burner. This modification to section is obtained by the translational movement along the axis X of the ring 30 connected to the control rod 43. In the retracted position, FIGS. 14, 16*a* and 17, the section of the passages 210, 211 are at a maximum, whereas when pushed, FIGS. 15, 16*b* and 18, the section of the passages 210, 211 is at a minimum.

Figure 17:
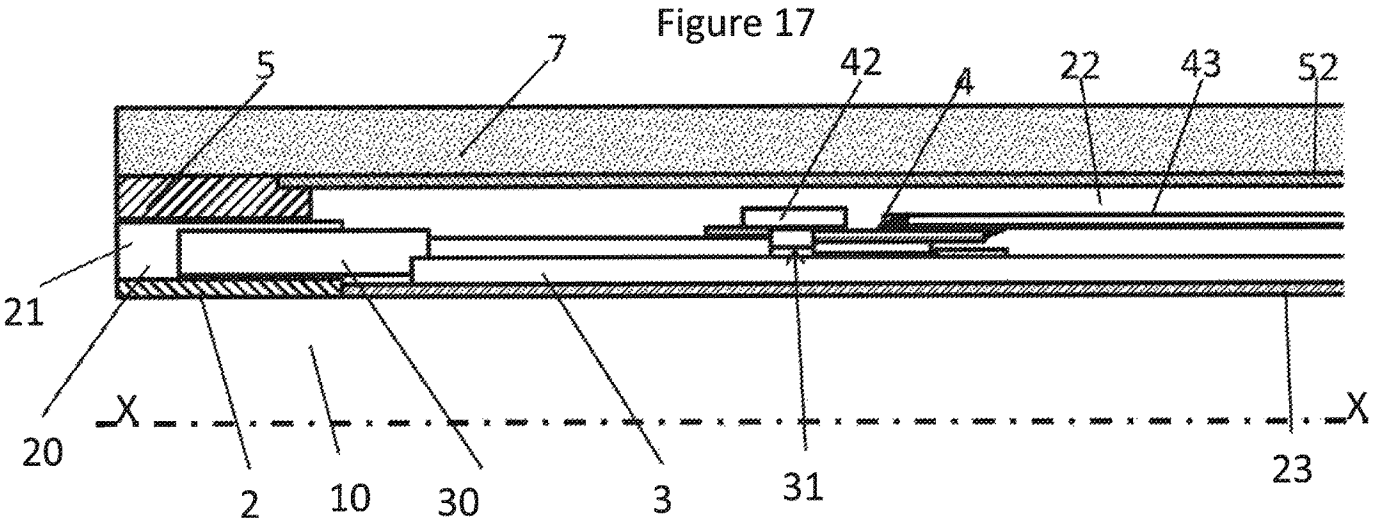
FIGS. 17 and 18 show a view in cross section of the burner in a particular arrangement in which the section of the gas or air circuit is adjustable.
Figure 18:
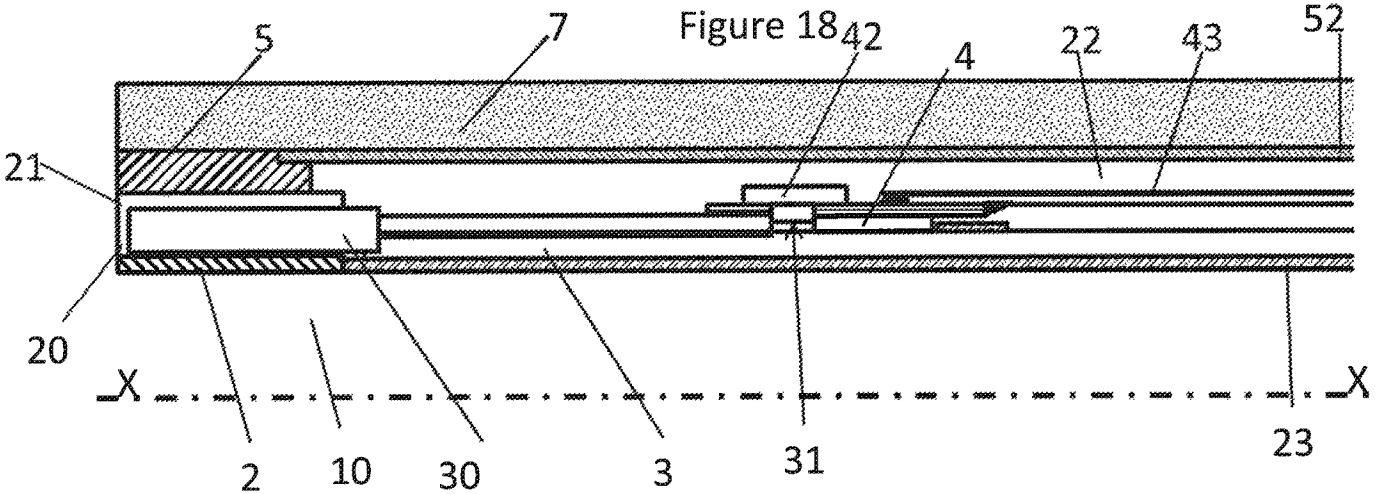

It may be seen from FIGS. 17 and 18 that the translational movements of the ring 30 take place along the axis X and are controlled by the tube or control rod 43, whereas the rotational movement of the ring 30 is obtained by the translational movement of the tube or of the control rod 43.

The optimal arrangement for drawing secondary air into the flame is to install this primary air circuit on the outside of the fuel circuits and notably the powder circuit. This arrangement limits the expulsion of solid fuels on the outside of the flame and reduces the formation of nitrogen oxides.

In the context of a burner having multiple air outlets, having this device situated just on the outside of the fuel circuit as illustrated in FIG. 2, notably the powdered fuel (carbon, pet coke, etc.) circuit and generally between the powdered-fuel circuit and the axial circuit means that it can be rotated in order to activate its combustion but that it also enjoys the benefit of the outlet orifices of the primary air circuit with a tangential component being arranged close to the secondary air so that the impulse of this circuit can be put to good use for absorbing secondary air into the flame.

In the configuration depicted in FIG. 10, the number of ducts 21 is a multiple of the number of axial ducts 50 or of groups of axial ducts 50, in order to improve the absorption of secondary air.

This is optimal when the number of ducts 21 is identical to the number of axial ducts 50 or groups of axial ducts 50 and when the ducts 21 are on the same radii as the ducts 50 or groups of ducts 50.

The invention claimed is:

1. A burner comprising:

a primary air or gas duct having an axis delimited by an exterior wall and a concentric interior wall;

radial ducts for gas or primary air injection comprising periphery notches of an interior annulus connected to the concentric interior wall;

a rotatable ring arranged on an exterior peripheral part of the concentric interior wall, wherein the rotatable ring comprises axial protrusions to define a plurality of distributors that cooperate with the radial ducts to form two passages of different angles in each of the radial ducts.

2. The burner according to claim 1, wherein the rotatable ring is translationally mobile.

3. The burner according to claim 1, wherein the two passages are formed by complementary flared shapes of one of the plurality of distributors and one of the radial ducts or the primary air or gas duct, and wherein a sum of sections of the two passages is constant in a plane perpendicular to the axis, whatever angular position of the rotatable ring.

4. The burner according to claim 1, wherein the plurality of distributors and the radial ducts or the primary air or gas duct comprise walls with parallel edges.

5. The burner according to claim 1, wherein the plurality of distributors and the radial ducts or the primary air or gas duct comprises curvilinear edges.

6. The burner according to claim 1, wherein the radial ducts and the plurality of distributors are chamfered at an upstream end.

7. The burner according to claim 1, further comprising axial primary air ducts.

8. The burner according to claim 7, wherein the radial ducts are sandwiched between the primary air or gas duct and the axial primary air ducts.

9. The burner according to claim 8, wherein the axial primary air ducts and the radial ducts are fed from the same supply.

10. The burner according to claim 7, wherein an amount of radial ducts is a multiple of an amount of the axial primary air ducts or an amount of a group of the axial primary air ducts.

11. The burner according to claim 10, wherein the radial ducts and axial primary air ducts are arranged on an identical radii.

12. The burner according to claim 5, wherein the rotatable ring comprises a slot arranged in an inclined manner with respect to the axis, wherein an inclination and length of the slot is proportional to rotation of the rotatable ring.

13. The burner according to claim 3, wherein the radial ducts comprise an outlet section that varies as a function of the relative movement of concentric interior wall with respect to the exterior wall, an interior radial face of the plurality of distributors and an external radial face of notches provided on the interior wall make an angle $\alpha$ with the axis, and an interior radial face of an exterior annulus makes an angle $\beta$ with the axis.

14. The burner according to claim 2, wherein the plurality of distributors and the radial ducts have a complementary flared shape, forming two passages and of which a sum of the sections is variable in a plane perpendicular to the axis, whatever an angular position of the rotatable ring.

* * * * *